US008123594B2

(12) United States Patent
Astorga Ramírez et al.

(10) Patent No.: US 8,123,594 B2
(45) Date of Patent: Feb. 28, 2012

(54) POST SHAVING ORBITAL SYSTEM FOR BLIND BOLT FASTENERS

(75) Inventors: Juan Ramón Astorga Ramírez, Madrid (ES); Juan Francisco García Amado, Madrid (ES)

(73) Assignee: Airbus Operations, S.L., Getafe (Madrid) (ES)

( * ) Notice: Subject to any disclaimer, the term of this patent is extended or adjusted under 35 U.S.C. 154(b) by 524 days.

(21) Appl. No.: 12/338,072

(22) Filed: Dec. 18, 2008

(65) Prior Publication Data

US 2010/0022172 A1 Jan. 28, 2010

(30) Foreign Application Priority Data

Jul. 23, 2008 (ES) ..... 200802196

(51) Int. Cl.
*B24B 23/00* (2006.01)
*B24B 55/06* (2006.01)

(52) U.S. Cl. ..... 451/11; 451/357; 451/456

(58) Field of Classification Search ..... 451/11, 451/357, 359, 454, 456
See application file for complete search history.

(56) References Cited

U.S. PATENT DOCUMENTS 3,199,251 A * 8/1965 Enders ..... 451/356
4,660,329 A * 4/1987 Hutchins ..... 451/357
5,031,364 A * 7/1991 Belanger ..... 451/359
5,425,666 A * 6/1995 Frank et al. ..... 451/344
6,267,653 B1 * 7/2001 Klink et al. ..... 451/271
7,220,174 B2 * 5/2007 Phillips et al. ..... 451/354

FOREIGN PATENT DOCUMENTS

RO 111835 2/1997

OTHER PUBLICATIONS

Spanish Search Report issued Jan. 15, 2010 in Spanish application 200802196, which is a counterpart to the present application (with partial English translation).

* cited by examiner

*Primary Examiner* — Robert Rose
(74) *Attorney, Agent, or Firm* — Wenderoth, Lind & Ponack, L.L.P.

(57) ABSTRACT

The system comprises a headstock (1) in which is established a rotary shaft (10) driven via a cone (8) that can be coupled to a drive means, for example a robot, the shaft (10) being linked to a spring (11) which permits axial displacement of the shaft (10) in the upward and downward direction, while coupled to the other end, with the interposition of an eccentric (21), is a plate (2) for carrying an abrasive disc (3) intended for sanding the pins of the fasteners, following the operation of shaving said pins. The eccentric (21) transforms the rotation of the shaft (10) into an orbital motion so that, in combination with the upward and downward displacements by means of the spring (11), the abrasive disc (3) is successfully adapted on the surface on which the pin of the fasteners intended to sand is located.

8 Claims, 2 Drawing Sheets

POST SHAVING ORBITAL SYSTEM FOR BLIND BOLT FASTENERS

OBJECT OF THE INVENTION

As stated in the title of this descriptive specification, the present invention relates to a roto-orbital tooling system, being intended for removing the cutting edges and eliminating small burrs generated in the fastener pins of the type Blind Bolt (e.g. type ABS0257), in which these cutting edges and burrs are originated as a consequence of the shaving of the pin.

The system constitutes a headstock designed for being used in Cartesian or parallel kinematic robots (e.g. Tricept type robot), with automatic riveting capacity and automatic tooling changer.

The system is preferably and fundamentally intended for application in the aeronautical industrial sector, in the fitting of aircraft skins, especially sustaining surfaces, like elevators and rudders.

PRIOR ART OF THE INVENTION

In the assembly process of the skin of the sustaining surfaces, as in elevators and rudders, the use of numerical control machines and robots is known. In a large majority of sustaining surfaces, Blind Bolt (or Lockbolt) fasteners are used. These fasteners have a threaded pin with the particular characteristic of that, once installed the fasteners, part of the threaded pin of the fastener remains projecting from it, being the dimension of which used to check the correct fitting of the fastener. This pin has to be cut in order to meet the requirements of aerodynamic cleaning on the sustaining surfaces of the aircraft. This cutting is achieved by means of a device developed for the purpose and described in Spanish invention patent P 200701064. Due to the fact that the pin of the blind rivet is threaded, the shaving thereof can produce certain defects such as sharp edges or small burrs, etc. Traditionally, in order to eliminate those defects, the surface is softly sanded using flexible abrasive discs applied by means of pneumatic tools. This method has two drawbacks since, on the one hand, a great physical effort is required by the operator, due to this being done manually, and, on the other hand, there exist problems of accessibility to riveted zones in very large elements, as is the case with large capacity sustaining surfaces of aircraft, all of which leads to a very high operating cost.

DESCRIPTION OF THE INVENTION

In order to solve the drawbacks referred to above, the invention proposes a system for sanding the fastener pins after they have been shaved, designed to be able to be used in parallel kinematic robots, being able to be stored in the automatic tooling changer, being loaded and unloaded automatically by the corresponding headstock of the robot.

More specifically, the system of the invention is driven by the electro-spindle of the robot, permitting the control over the machining parameters such as the revolutions per minute and the direction of rotation, this latter aspect being highly relevant since the abrasive disc needs to rotate to the left in order to manage to "hook up to" and eliminate the burrs generated around the pins.

Another characteristic of the system is the incorporation of means which permit the length of the headstock unit to be adapted while is working, with a range up to 14 mm, and thereby to absorb possible local deformations of the skin of the sustaining surface. Specifically, the means that permit this length to be adapted are based on a compression spring which also allows to transfer a constant and calculated pressure on the surface of the skin, thus avoiding stresses which could affect the structural integrity of the sustaining surface.

The headstock includes a shaft which is precisely that on which the spring referred to above acts, and this shaft is able to rotate by being driven by the electro-spindle to which it can be coupled, and whose rotation is converted into a rotary-orbital one as a consequence of the fact that the lower end of the shaft, precisely where the corresponding abrasive-carrier plate is mounted, incorporates an eccentric as a coupling element between the said shaft and the said abrasive-carrier plate, which causes the rotation of the shaft to become converted into an orbital motion and so, in combination with the upward and downward displacements that can be produced by the spring, it can adapt itself to the different irregularities of the surface on which the abrasive-carrier plate rests in order to perform the sanding of the fastener pin.

Finally, it can be said that the system is complemented with a suction duct for the swarf and dust given off, which is coupled to the lower part of the headstock and guided on top in a support fixed to the part of the headstock where the actual shaft with the spring is axially mounted.

BRIEF DESCRIPTION OF THE DRAWINGS

In order to complement the description that is going to be made forthwith, and with the aim of facilitating a better understanding of the characteristics of this invention, this specification is accompanied by a set of drawings on the basis of which the innovations and advantages of the system forming the inventive object will be more easily understood.

DESCRIPTION OF THE PREFERRED FORM OF EMBODIMENT

Figure 1:
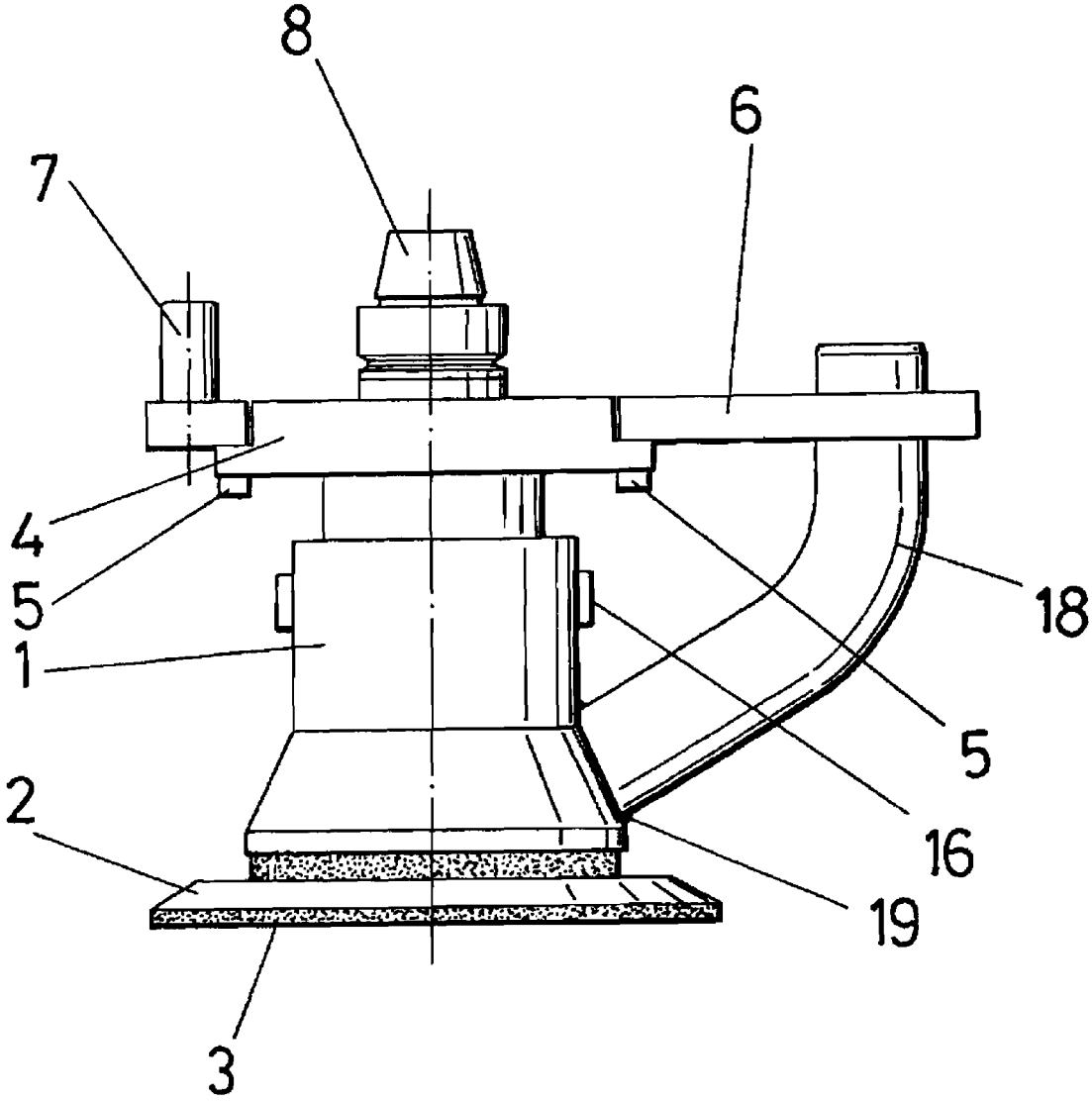
FIG. 1.—Shows a schematic view according to a sideways elevation of the headstock in which the inventive system has been materialized, in the rest position.
Figure 2:
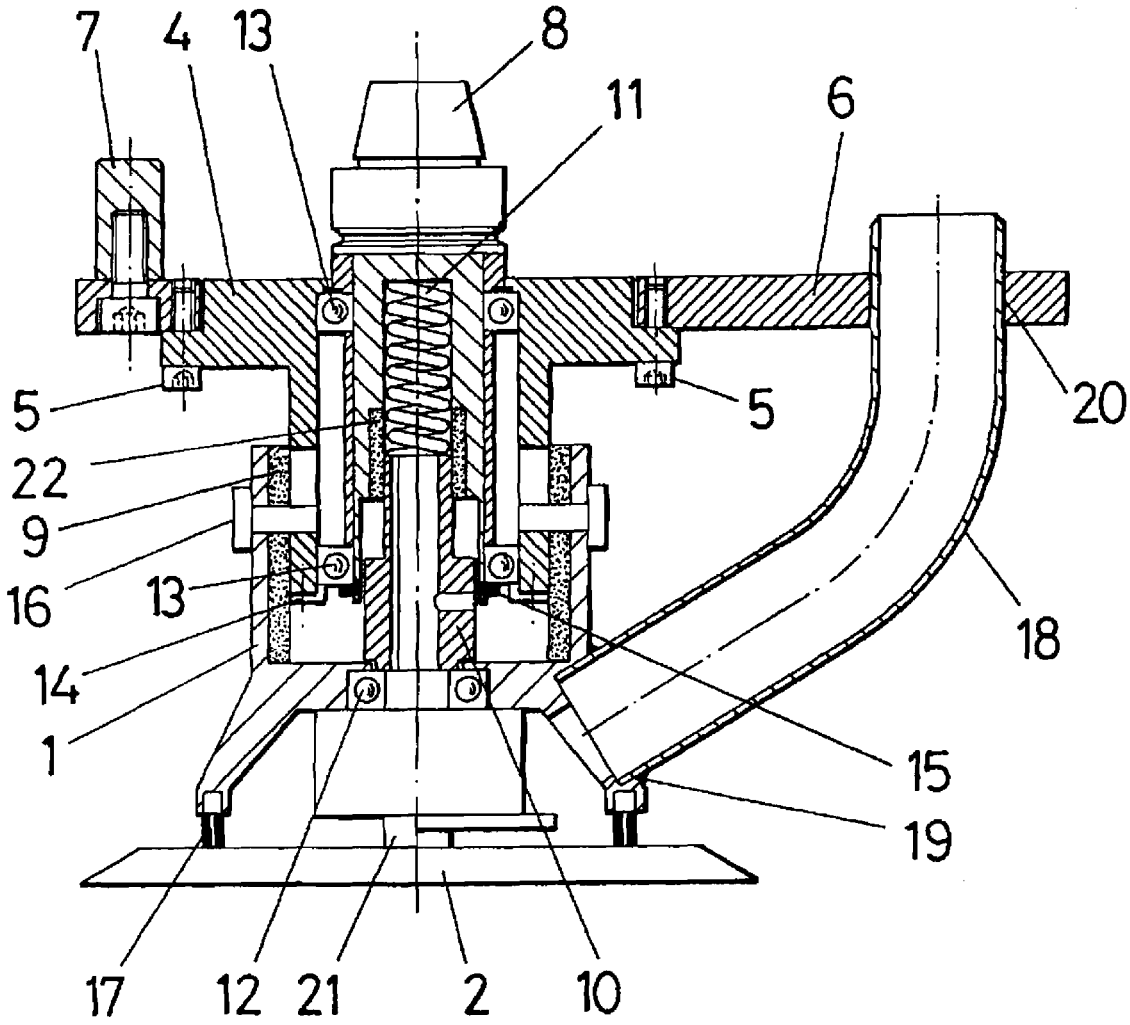
FIG. 2.—Shows a schematic view in cross-section of the same headstock as represented in the previous figure, allowing the components and elements involved therein to be seen.

With the commented figures in view, we can see the headstock 1 in which the system of the invention is materialized, fitted at the lower of which is a plate 2 carrying the corresponding abrasive disc 3 by means of which the post-shaving orbital sanding of the fasteners will be effected, said headstock comprising an upper body 4 to which is fixed, by means of the corresponding screws 5, a support 6 which on one side includes a halting or anti-rotation stud 7 for the entire system, and from which body 4 there emerges a cone 8 as a connection element to the electro-spindle of the drive element, such as a robot or component thereof.

The headstock 1 comprises a casing corresponding to the actual reference 1, between which and the body 4 a friction collar 9 is inserted.

The system furthermore includes a shaft 10 able to rotate and in turn be displaced axially, which rotation will be effected by the cone 8, while the axial displacement is able to be carried out by means of a spring 11, said shaft 10 presenting a lower bearing 12 and other lower bearings 13 of the unit, the bearing 13 being retained by means of a retaining cover 14, with a rubber seal 15 being provided beneath said bearings.

The casing 1 is complemented with a guide 16 and below with a protective curtain 17 which prevents the dispersal of swarf and dust produced by the functioning of the system, this swarf and dust being collected and evacuated by means of a suction duct 18 fixed via its lower end by means of welding 19 to the actual casing 1, while via its upper end it is guided in a neck 20 established for the purpose in correspondence with the support 6.

The coupling between the shaft 10 and the plate 2 carrying the abrasive disc 3 is carried out by means of an eccentric 21 which converts the rotary motion of the shaft 10 into an orbital motion, all this in such a way that in combination with the function performed by the spring 11 of pressing the shaft 10 downwards, a continuous adaptation take place of the plate 2 and therefore of the abrasive disc 3 on to the surface on which the system acts, specifically in the operation of sanding the cutting edges and/or small burrs remaining on the pin once the shaving of this pin has been carried out by the corresponding fastener pin cutting machine.

Returning to the spring 11, the function of this is to establish or exert a constant and calculated pressure on the surface of the skin on which the pins of the fasteners intended to be sanded are applied, thereby avoiding stresses which could affect the structural integrity of the sustaining surface to which that skin surface belongs.

Finally, it can be said that the shaft 10 is guided in a polygonal collar 22 which on the one hand pulls that shaft 10 in rotation and on the other hand it permits the axial displacement thereof.

The invention claimed is:

1. A post shaving orbital system for blind bolt fasteners, being intended for the elimination of edges and burrs generated in a threaded pin of a fastener, following shaving or cutting of surplus corresponding to said pin the system comprising: a headstock with a coupling cone for coupling the system to a drive unit; the coupling cone being connected to a shaft with means for producing an orbital rotation which, in combination with a spring which allows an upward/downward axial displacement of the shaft, establishes the adaptation, of a plate for carrying an abrasive disc, to a surface of a body in which said pin is fitted, so that the pin, previously shaved, is sanded on said surface of the body; said plate being coupled to a lower end of the shaft;

wherein the rotating shaft is guided on a polygonal collar, which permits axial displacement of said shaft and produces a pulling and corresponding rotation of the latter in the rotary motion of the coupling cone to which it is connected.

2. A post shaving orbital system for blind bolt fasteners, according to claim 1, wherein the plate for carrying the abrasive disc is coupled to the shaft by means of by an eccentric, via which a rotary motion of said shaft is transformed into an orbital motion.

3. A post shaving orbital system for blind bolt fasteners, according to claim 1, wherein the spring is connected to the shaft, allowing an axial displacement of the latter in order to permit its length to vary and achieve the adaptation of the abrasive disc fitted on the plate on the surface on which the pin of the fastener to rub down is applied.

4. A post shaving orbital system for blind bolt fasteners, according to claim 1, further comprising a lateral duct for suction of swarf and dust, in correspondence with the lower part of a casing of the headstock; the duct being joined by welding to the lower part of the casing of the headstock and via the upper part is guided in a neck provided in correspondence with a support fixed to the body, the shaft being fitted between the body and the casing of the headstock.

5. A post shaving orbital system for blind bolt fasteners, according to claim 4, whereby in correspondence with the lower part of the casing of the headstock a protective curtain has been provided which prevents the outward projection of swarf and dust, in order to achieve their suction and corresponding evacuation via the duct.

6. A post shaving orbital system for blind bolt fasteners, according to claim 2, wherein the spring is connected to the shaft, allowing an axial displacement of the latter in order to permit its length to vary and achieve the adaptation of the abrasive disc fitted on the plate on the surface on which the pin of the fastener to rub down is applied.

7. A post shaving orbital system for blind bolt fasteners, according to claim 1, wherein the polygonal collar is constituted by a square collar.

8. A post shaving orbital system for blind bolt fasteners, according to clam 1, wherein the drive unit is constituted by a Tricept robot.

* * * * *